US006996921B2

(12) United States Patent
Kolb et al.

(10) Patent No.: US 6,996,921 B2
(45) Date of Patent: Feb. 14, 2006

(54) WEB POSITIONING DEVICE

(75) Inventors: William Blake Kolb, Woodbury, MN (US); Don W. Hendrickson, Hugo, MN (US); Gary L. Huelsman, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/778,297

(22) Filed: Feb. 13, 2004

(65) Prior Publication Data

US 2004/0159003 A1 Aug. 19, 2004

Related U.S. Application Data

(60) Provisional application No. 60/447,820, filed on Feb. 14, 2003.

(51) Int. Cl.
*F26B 13/00* (2006.01)

(52) U.S. Cl. ..... 34/525; 34/556; 34/572; 34/635

(58) Field of Classification Search ..... 34/653, 34/525, 527, 530, 538, 556, 572, 92, 631, 34/635; 226/11, 95, 97.1, 97.4, 92; 242/563; 162/193, 286, 198, 194, 263
See application file for complete search history.

(56) References Cited

U.S. PATENT DOCUMENTS

| | | | | |
|---|---|---|---|---|
| 2,710,154 A | | 6/1955 | Baumrucker, Jr. et al. | |
| 3,032,245 A | | 5/1962 | George et al. | |
| 3,259,288 A | | 7/1966 | Wassermann | |
| 3,396,887 A | | 8/1968 | Bade | |
| 3,489,325 A | | 1/1970 | Epstein et al. | |
| 3,780,960 A | | 12/1973 | Tokuno et al. | |
| 3,799,419 A | | 3/1974 | Herzhoff et al. | |
| 3,891,158 A | | 6/1975 | Shearon et al. | |
| 3,939,032 A | | 2/1976 | Taitel et al. | |
| 3,956,047 A | | 5/1976 | Johnson | |
| 4,025,026 A | * | 5/1977 | Merritt et al. | 226/7 |
| 4,116,399 A | | 9/1978 | Mosburger et al. | |
| 4,170,506 A | | 10/1979 | Marschke | |
| 4,264,384 A | | 4/1981 | Karanastassis | |
| 4,326,656 A | * | 4/1982 | Gregory et al. | 226/59 |
| 4,390,388 A | | 6/1983 | Nagata et al. | |
| 4,462,528 A | | 7/1984 | Kisler | |
| 4,481,053 A | | 11/1984 | Tokuno et al. | |
| 4,646,446 A | * | 3/1987 | Bubley | 34/278 |
| 4,836,464 A | * | 6/1989 | Perego | 242/417.1 |
| 4,880,178 A | | 11/1989 | Goulette | |
| 5,456,869 A | | 10/1995 | Miles et al. | |
| 5,581,905 A | | 12/1996 | Huelsman et al. | |

(Continued)

FOREIGN PATENT DOCUMENTS

DE 809 883 C 8/1951

*Primary Examiner*—Kenneth Rinehart
(74) *Attorney, Agent, or Firm*—Brian E. Szymanski; David R. Cleveland

(57) ABSTRACT

A web positioning device includes one or more ports positioned in or adjacent at least one platen of a gap drying system, wherein upon generation of a vacuum force through each port, movement of a web of material conveyed through the gap drying system is arrested by drawing a first face of the web of material into contact with a portion of the web positioning device immediately surrounding each port. A method for controlling movement of a portion of a web of material using the web positioning device is also presented.

11 Claims, 5 Drawing Sheets

U.S. PATENT DOCUMENTS

| | | | |
|---|---|---|---|
| 5,589,247 | A | 12/1996 | Wallack et al. |
| 5,679,195 | A | 10/1997 | O'Dwyer et al. |
| 5,686,142 | A | 11/1997 | Wallack et al. |
| 5,694,701 | A | 12/1997 | Huelsman et al. |
| 5,779,184 | A | 7/1998 | Kaufmann et al. |
| 5,881,476 | A | 3/1999 | Strobush et al. |
| 5,975,457 | A | 11/1999 | Forbes |
| 5,996,246 | A | 12/1999 | Marschke |
| 6,016,989 | A | 1/2000 | Gangemi |
| 6,152,068 | A | 11/2000 | Colson et al. |
| 6,228,205 | B1 | 5/2001 | Rhodes et al. |
| 6,256,904 | B1 | 7/2001 | Kolb et al. |
| 6,276,421 | B1 | 8/2001 | Valenti et al. |
| 6,425,513 | B1 * | 7/2002 | Madrzak et al. ..... 226/92 |
| 6,451,145 | B1 | 9/2002 | Forbes |
| 6,511,708 | B1 | 1/2003 | Kolb et al. |
| 6,537,406 | B1 | 3/2003 | Jensen, Jr. et al. |
| 6,576,296 | B1 | 6/2003 | Yapel et al. |
| 2002/0050324 | A1 | 5/2002 | Middelstadt et al. |
| 2002/0100414 | A1 | 8/2002 | Colson et al. |

* cited by examiner

WEB POSITIONING DEVICE

CROSS-REFERENCE TO RELATED APPLICATION(S)

This application claims priority from U.S. Provisional Patent Application Ser. No. 60/447,820 filed Feb. 14, 2003.

BACKGROUND OF THE INVENTION

The present invention relates generally to a method and apparatus for controlling the position of a web of material along a web processing path. More particularly, the present invention relates to a web positioning device for use with a gap drying device.

Web coating machines (i.e., web processing lines) are known in the art. The coating of a web requires first applying a coating to the web of material. In many coating applications, there follows a requirement to dry the coating on the web. With a typical web coating machine, the web travels along a path through the machine, to a coating station, then through one or more dryers and eventually to a winder. Any number of rollers, idlers, drive, brake and steering mechanisms may be located along the web coating machine. Additional processing equipment, for example an ultra violet (U.V.) station, may be further included as desired for particular web processing applications.

The coating station applies a coating to one face of the web. The "coated" face refers generally to a portion of the web of material which is sensitive to contact and contamination, though portions of the coated face may have been dried on the web. Coatings can be adhesives that are sensitive to any contact. Moreover, coatings are often applied with a liquid component (e.g., a solvent) that must be evaporated or otherwise removed before the coating is processed to a desired finished state.

Gap dryers, such as those described in U.S. Pat. Nos. 5,694,701 and 5,581,905, are known in the art for drying a coated web of material without the need for applied convection to evaporate and collect liquid coating materials. Gap dryers may be included in web coating machines. Gap dryers typically include a lower platen and an upper platen (also known as upper and lower plates) spaced from the lower platen by a relatively small gap. The web of material passes through a small gap between the upper and lower platens as the web travels through the coating machine. Passing the coated web between the upper and lower platens results in condensate forming on a surface of the upper platen. The upper platen forms a condensing structure for collecting condensate that has been evaporated from the web of material and for directing that condensate to a desired location. The upper platen can be chilled to facilitate the condensing process. In addition, the lower platen can be heated to further evaporation of the liquid from the web of material.

An air floatation oven, such as a convection dryer, may also be provided downstream of the gap dryer, for further drying of a coated web. The coated web generally passes through the gap dryer before passing through the air floatation oven, in order to avoid damage to the undried coating material caused by air movements in the air floatation zone.

As the web travels through the coating machine, inadvertent web upsets may occur. Upsets include any event that disrupts normal travel of the web through the coating machine, and include events that disrupt the longitudinal tension of the web. Upsets occur most often at the coating station and in the dryer. Such upsets lead to costly losses of time and materials. In particular, upsets can damage the sensitive coated face of the web. Upsets in a coating machine having a gap dryer can damage the coated web when the coated face of the web contacts the upper condensing platen of the gap dryer. Contact with the upper condensing platen can cause transfer of condensate from the upper condensing platen to the web, which can cause significant damage to the coated web, as well as raising safety and hygiene concerns. Contact of the web with the upper condensing platen can further cause contamination of the upper condensing platen, and contamination of capillary grooves of the upper platen with coating material is detrimental to both gap dryer functioning and machine operation.

Upsets also include web breaks, which are events that sever or tear a portion of the web. A change in the tension of the web, often a reduction in the tension, can lead to the web upset problems discussed above. In addition, web breaks often cause portions of the web to fall or pull through the web coating machine due to gravity. In that instance, the web may contact a ground surface, potentially contaminating the web and spreading undesired material to undesired areas, such as to other components of the coating machine and to the ground surface.

A web coating machine is generally characterized as including a number of tension zones. While the web may be generally secured at ends of each tension zone in the event of a web break, such tension zones may extend along a significant length of the web which can still pull through the web coating machine, and cause the types of difficulties described above.

In order to continue processing and coating a web when there is a break in the web through the coating machine, workers must splice severed portions of the web and then re-thread the spliced web through the coating machine. Splicing and re-threading the web through the coating machine, in particular re-threading the web through the air floatation oven, is difficult and time consuming. In addition, workers may re-thread portions of the web that have become contaminated, potentially spreading contamination to sensitive areas of the web coating machine. Because coating machine down time due to web upsets reduces the production output, it is important to limit the detrimental effects of inadvertent web upsets in order to maximize productivity and cost-effectiveness. Also, because precision coating processes have relatively narrow tolerances, web upsets can generate undesired waste.

Web breaks are most common at or near the following areas: the coating station, the air floatation oven, the unwinder, the winder, and at other processing equipment (e.g., the U.V. station). Also, web breaks are common at portions of the web where a splice has already been made. Splices are sometimes performed imperfectly, which can cause the splice to come undone and effectively cause a web break. Splices made with adhesives often come undone as the spliced portion of the web passes through the air floatation oven, due to elevated temperature.

Known mechanical and electrostatic web clamps, such as those disclosed in U.S. Pat. No. 4,462,528, can be used in conjunction with the web coating machine to hold the web in a static position. Holding the web in a static position prevents the web from pulling through the machine during inadvertent web breaks, and limits damage and disruption caused by web upsets. However, mechanical and electrostatic web clamps present a number of problems.

Mechanical web clamps contact both faces of the web, holding the web in a static position by frictional contact. Contact with a coated or wet face of the web causes damage to such a coated face, thereby generating waste product. In addition, contact with the coated material can contaminate the web clamp, generally necessitating cleaning of the mechanical web clamp after activation. Moreover, conventional mechanical web clamps can exhibit slow response times, reducing effectiveness of the mechanical clamp in preventing damage to the web from upsets when the tension of the web changes.

Electrostatic web clamps are limited in their usefulness. Electrostatic web clamps may be used only with insulative web materials, and not conductive web materials. Moreover, electrostatic clamps cannot be used in volatile and explosive material conditions, when the coating, the web, or other involved materials are volatile and/or explosive. In addition, electrical classification concerns are raised with the use of electrostatic web clamps, meaning electrostatic web clamps are typically limited to use in general purpose areas, absent significant additional costs. Moreover, electrostatic web clamps utilize face side brushes in close proximity to the coated surface of the web. Web flutter and contamination concerns are present due to the proximity of the brushes to sensitive coated areas of the web.

Also known are splicing machines that can hold a web or initiate a splicing procedure after a web break occurs. However, those splicing machines do not provide control over the positioning of a web upon a general web upset, nor do those splicing machines provide web positioning control with a web coating machine including a gap dryer.

Thus, an effective web positioning device is needed to provide control over the positioning of a web along a web processing path when the web advance is stopped.

BRIEF SUMMARY OF THE INVENTION

A web positioning device according to the present invention includes one or more ports positioned in or adjacent at least one platen of a gap drying system, such that upon generation of a vacuum force through each port, movement of a web of material conveyed through the gap drying system is arrested by drawing a first face of the web of material in contact with a portion of the web positioning device immediately surrounding each port. A method for controlling movement of a portion of a web of material using the web positioning device is also presented.

While the above-identified drawing figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principals of the invention. The figures may not be drawn to scale. Like reference numbers have been used throughout the figures to denote like parts.

DETAILED DESCRIPTION

Figure 1:
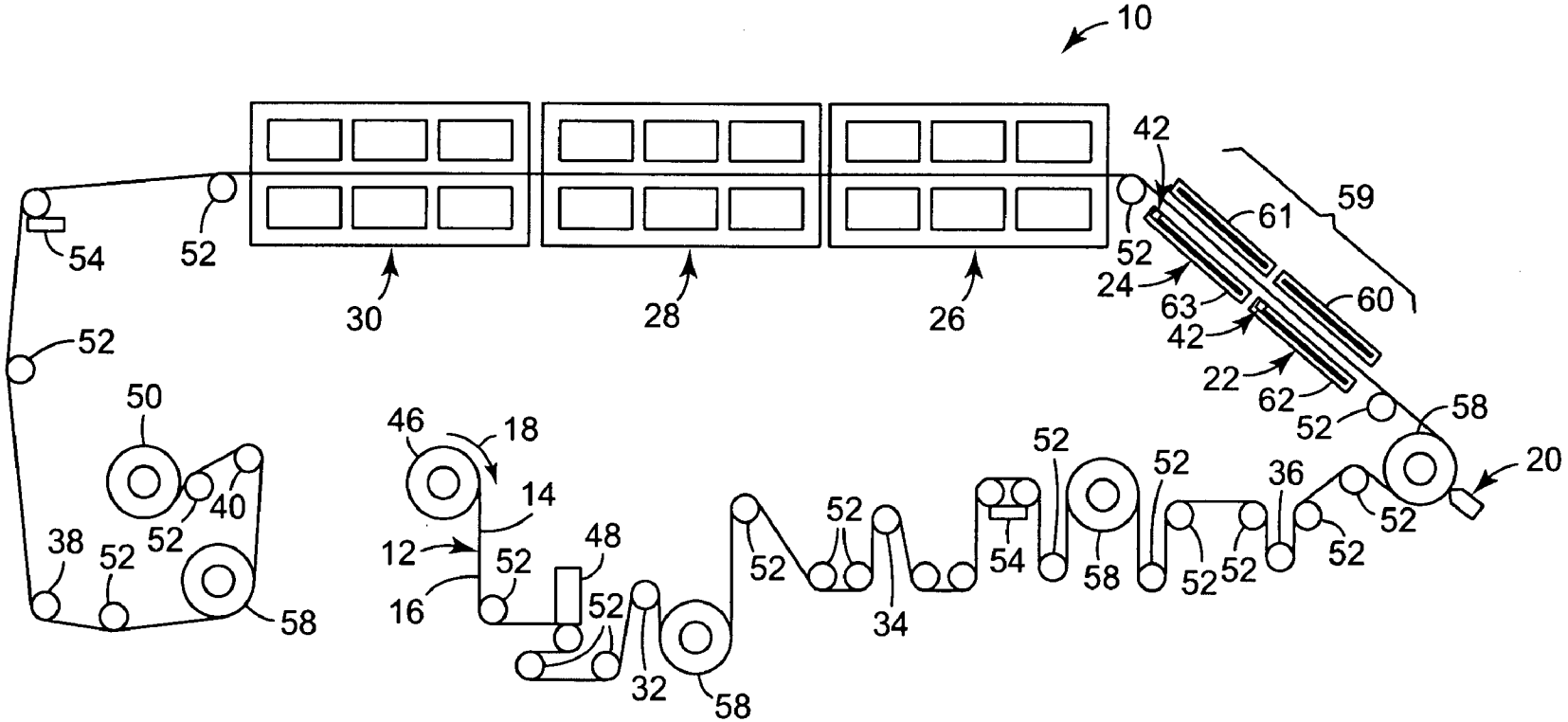
FIG. 1 is a schematic representation of a web coating machine, showing the web travel path.

FIG. 1 is a schematic representation of a web coating machine 10 (i.e., a web processing line). In the web coating machine 10, a web of material 12 having a first face 14 and an opposite second face 16 moves along a web processing path through the web coating machine, with a direction of travel 18 generally aligned longitudinally with the web of material 12. The web coating machine 10 includes a coating station 20, one or more dryers 22–30, one or more sensors 32–40 (e.g., tension rolls), a web positioning device 42, and a system controller (not shown). The web coating machine 10 further includes, as appropriate for the types of web processing desired, guidance components such as an unwinding means 46, an unwind dancer roll assembly 48, and a winding means 50, as well as a suitable number of idler rollers 52, steering means 54, and pull rolls 58 (e.g., vacuum pull rollers). In further embodiments, additional processing equipment, for example an ultra violet (U.V.) station and web cleaners (not shown), may be further included.

The web of material 12 is typically transported through the web coating machine 10 by the vacuum pull rollers 58, which are devices known in the art for moving webs. The steering means 54 directs lateral movement of the web 12 through the coating machine 10. The web 12 is also guided by idler rollers 52 that passively roll with movement of the web 12. Tension rollers 32–40 are located at various points throughout the web coating machine 10.

Tension zones are defined as portions of the web travel path between tension-influencing components, such as the unwind means 46, the winding means 50, and the pull rolls 58. Web tension is normally held substantially constant through each individual tension zone. Typically, at least one tension roller for monitoring web tension is located in each tension zone.

The web 12 generally travels through the web coating machine 10 from the unwinding means 46 to the coating station 20, where a coating substance is applied to the second face 16 of the web of material 12. Once coated, the second face 16 of the web 12 is also referred to as a coated or wet face of the web 12. The coating is a substance typically in liquid form, and may be almost any type of substance, including, for example, an adhesive. Coatings are often applied with a liquid component, such as a solvent, that must be evaporated or otherwise removed before the coating dries to a desired finished state.

The web 12 then travels from the coating station 20 to one or more dryers 22–30, including, for example, gap dryers 22 and 24. Eventually the coated web 12 travels to the winding means 50 near an end of the web processing path, where the web of material 12 is typically wound into a roll. The first face 14 of the web 12 remains substantially dry, permitting contact with transporting components (e.g., rollers) without damaging or contaminating either the web 12 or the web coating machine 10.

Gap drying systems are known in the art, such as those disclosed in U.S. Pat. Nos. 5,694,701 and 5,581,905, incorporated herein by reference in their entirety. The gap dryers 22 and 24 are capable of evaporating and collecting a liquid portion of the coating solvent.

The individual gap dryers 22 and 24 collectively define a gap drying system 59. Individual gap dryers 22 and 24, which may be referred to as gap drying zones, are conveniently located adjacent each other along the web path. The gap dryers 22 and 24 generally include an upper platen 60 and 61 and a lower platen 62 and 63 spaced from the upper platen 60 and 61 by a first spacing or distance S (see FIG. 2). The upper and lower platens 60 and 62 are also known as upper and lower plates. Because the gap drying zones 22 and 24 are substantially identical, reference hereinafter will be generally made with respect to the gap dryer 22 only.

The coated web 12 passes between the upper and lower platens 60 and 62 of the gap dryer 22. The upper platen 60 comprises a condensing structure, which acts to condense liquid evaporated from the coated web 12 and to collect such condensate. The upper platen 60 may include, for example, a capillary surface for transporting condensate liquid away from the upper platen 60 and toward a collection trough (reference numeral 77 in FIG. 2B). The upper platen 60 may be cooled to facilitate condensing evaporated liquid. The lower platen 62 often has an upper surface with an arcuate shape in direction of web travel 18 (i.e., the longitudinal web travel path), which allows an air-bearing surface to be formed as a moving portion of the web 12 "floats" above the lower platen 62 on a small cushion of air. (See for example U.S. Pat. Nos. 6,511,708 and 6,256,904 herein incorporated by reference in their entirety). The lower platen 62 can also be heated to facilitate the evaporation of liquid from the coated web 12. Temperatures of the upper and lower platens 60 and 62 will vary according to the particular materials and coating processes involved. In further embodiments, the upper and lower platens 60 and 62 of gap dryer 22 may be in other shapes and configurations, as is known to those skilled in the art.

After passing through the gap drying system 59, the web 12 may then travel through one or more air floatation ovens 26–30 for further drying of the coating applied to the web 12. Air floatation ovens 26–30 utilize convection drying for further drying the coating on the web 12. The air floatation ovens 26–30 are usually located downstream from the gap drying system 59.

The sensors 32–40 are placed along the web processing path for monitoring characteristics of the web 12, and can be of any number of types known in the art, including a tension transducer (e.g., a Cleveland-Kidder Type UPB or EC-IT sensor manufactured by Cleveland Motion Controls, Cleveland, Ohio), or a position sensor (e.g., an imaging system, a laser, a capacitance sensor, or a pneumatic sensor). The sensors 32–40 can be used to detect the occurrence of a specified condition that affects movement of the web 12, for example, by monitoring a tension of the web 12. Besides being useful for fine control of the coating process, information about the tension may be useful for detecting web upsets, including web breaks. This is because web upsets generally correspond to a variation in a tension of the web 12 as it travels through the web coating machine 10. Therefore it is convenient to have at least some of the sensors 32–40 detect, for example, a specified condition as a function of the longitudinal tension of the web 12. In further embodiments, the specified condition may be time dependent. For example, the specified condition may be a variance in the tension of the web 12 for a period greater than a predetermined length of time. Such time dependent specified conditions allow acute tension variances, if sufficiently small and short, to occur without stopping operation of the web coating machine 10. In all embodiments, each of the sensors 32–40 typically sends a signal indicating the occurrence of the specified condition, and the system controller then coordinates, inter alia, activation of the web positioning device 42.

Figure 2:
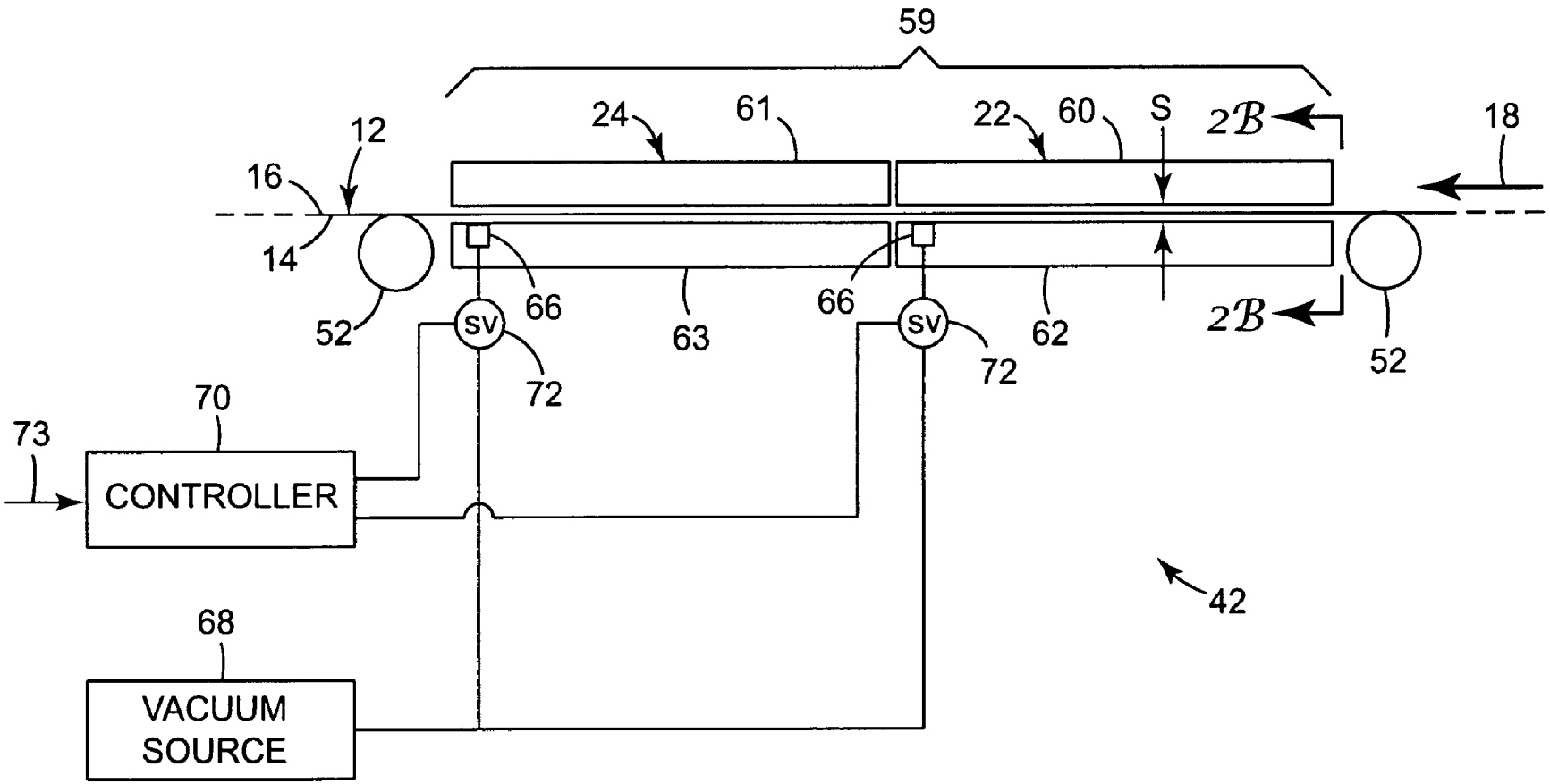
FIG. 2 is a schematic representation of a gap dryer and a first embodiment of a web positioning device, shown in a web processing position.

FIG. 2 is a schematic representation of a gap dryer and a first embodiment of a web positioning device 42. The web positioning device 42 is positioned along the web processing path for controlling movement of the web of material 12. The web positioning device 42 includes one or more gas flow ports 66, a vacuum source 68, a controller 70, and a control valve 72 for each gas flow port 66. More than one web positioning device 42 may be utilized with a single web coating machine 10, with the multiple web positioning devices 42 spaced longitudinally along the path of the web 12.

Generation of a vacuum or vacuum force through the gas flow port 66 (i.e., the cross web slot) can be used to reduce, retard and arrest movement of the web 12 relative to the gap drying system 59. In particular, the vacuum force draws a face of the web 12 toward each gas flow port 66. Contact between the first face 14 of the web 12 and a portion of the web positioning device immediately surrounding each gas flow port 66, typically a portion of the lower platen 62 and 63 or other structure near where each gas flow port 66 is located, reduces movement of the web 12. Activation of the vacuum force permits the web 12, or a portion thereof, to be held in a static position. The vacuum force need not generate a complete vacuum but may be any suitable pressure differential for use in quickly arresting the advance of the web 12 along the web travel path.

The vacuum source 68 provides gas displacement for generating a vacuum force through each gas flow port 66. Types of suitable vacuum source devices 68 include motor driven vacuum blowers/pumps, such as a Spencer USA Vortex Blower Model 07H531W43561 manufactured by the Spencer Turbine Company, Windsor, Conn., and venturi-based devices, such as a Model 301B, manufactured by the Nortech Corporation, Midland Park, N.J. In one embodiment, a venturi-based vacuum source 68 is used. While a single vacuum source 68 can serve all the gas flow ports 66 of the web coating machine 10 (as shown in FIG. 2), it is possible to utilize multiple vacuum sources. In one embodiment, the vacuum source 68 generates a pressure of about 17.0 inches Hg at 0° C. (56 kPa). The pressure generated by the vacuum source 68 can be varied if desired, according to the types of processing applications involved.

As seen in FIG. 2, the control valves 72, typically solenoid valves, are provided between the gas flow ports 66 and the vacuum source 68, in fluid communication therewith. The solenoid valves 72 regulate gas flow through each corresponding gas flow port 66. Each solenoid valve 72 is connected to the controller 70, for example a PLC controller, which is, in turn, operably connected to a control system (not shown), which enables opening and closing of the solenoid valves 72 to be linked to a web sensor and other components of the web coating machine. The control valves 72 are located as close as possible to the respective gas flow ports 66, and are of a large capacity, fast acting design, such as the model 58C-82-RA valve manufactured by MAC Valves, Inc., Wixom, Mich. It is preferred to minimize volume after the valves 72, meaning the volume of air that is evacuated between the solenoid valve 72 and its corresponding gas flow port 66, in order to improve response time of the web positioning device 42. Locating the control valves 72 in close proximity to the lower platens 62 and 63 generally minimizes the volume after the valve 72. Each gas flow port 66 typically has its own control valve 72, for improving speed performance and minimizing response time. The vacuum source 68 is typically continuously activated, such that opening the solenoid valve 72 to activate the web positioning device 42 only requires evacuating gases after the solenoid valve 72.

When a sensor, such as tension sensors 32–40, detects a web upset, an upset signal is transmitted to the control system. The control system in turn provides as activation signal 73 (FIG. 2) to the controller 70, which activates the web positioning device 42 by firing the solenoid valves 72 in response to the upset signal from the sensor.

Additionally, the web positioning device 42 may be activated by control sequences, and during shut-down of the web coating machine 10. There need not be a web upset in order to activate the web positioning device 42 to hold the web 12 in a static position. It may be desirable to activate the web positioning device 42 at such times in order to avoid the web 12 from being pulled through the web coating machine 10 and to avoid inadvertent contact with a coated face of the web 12.

After activation of the vacuum in response to an upset, a worker can adjust the web of material 12 as needed (e.g., by making a web splice at a web break location), and then resume operation of the web coating machine 10. Because the pull rolls 58 "grip" the web the web 12 is typically held in tension at boundaries of the tension zone where the upset occurs. Activation of the web positioning device 42 creates a tension sub-zone along the web travel path for minimizing undesired effects of a web upset, by localizing and generally containing the upset to the tension sub-zone. Thus, by activating the web positioning device 42, a web upset, such as a web break, generally affects only a small portion of the web 12 through the tension sub-zone rather than a substantial portion of the web 12 through the entire tension zone.

Figure 2A:
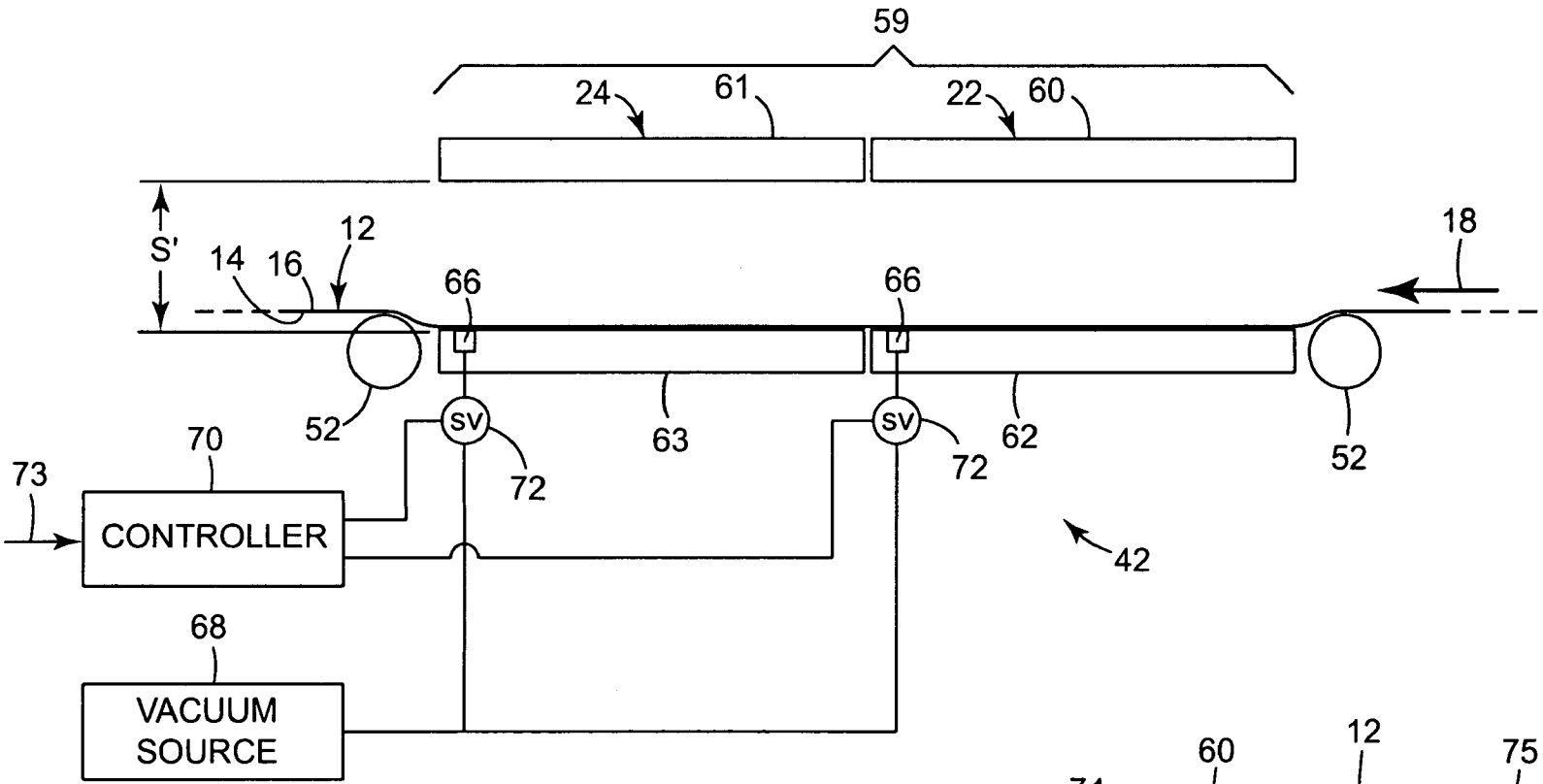
FIG. 2A is a schematic representation of the gap dryer of FIG. 2, shown in a web upset response position.

In one embodiment, the spacing between the upper platens 60 and 61 and the lower platens 62 and 63 is increased automatically when the vacuum ports 66 are activated. The control system typically activates the solenoid valves 72 and increases the platen spacing S simultaneously. The spacing S between the upper platens 60 and 61 and the lower platens 62 and 63 of the gap drying system 59 increases from the normal processing position (FIG. 2) to the upset position with increased platen spacing 5' (FIG. 2A). Those skilled in the art will recognize that spacing of the platens in the normal position, as well as in the upset position, will vary according to the particular configuration of the gap drying system 59 and the particular types of webs 12 and coatings involved. For illustrative purposes only, spacing in the normal position could be about one-quarter (¼) inch (0.635 cm) and spacing in the upset position could be about 1.5 inches (3.81 cm). In addition, because movement of the platens is a mechanical process, the web 12 may still be moving relative to the platens before the platens reach the upset position. In other words, the web 12 may still be moving while the spacing between the upper platens 60 and 61 and the lower platens 62 and 63 is still increasing after activation of the vacuum force.

Figure 2B:
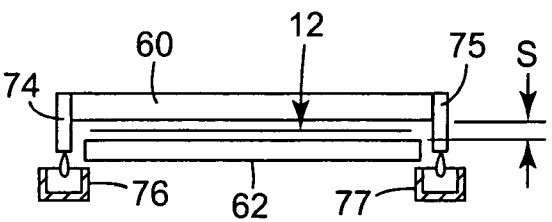
FIG. 2B is a sectional view as taken along line 2B—2B in FIG. 2.

By increasing the spacing between the upper platens 60 and 61 and the lower platens 62 and 63, more clearance can be provided between the coated web 12 and the upper platens 60 and 61. As shown in FIG. 2B, a pair of side plates 74 and 75 and troughs 76 and 77 for collecting liquid condensate and moving such condensate away from the upper platen 60 are provided. The troughs 76 and 77 may or may not be connected to the side plates 74 and 75. When a trough is connected to its respective side plate, the trough is moved together with the top platen 60 and the side plates 74 and 75 relative to the lower platen 62 (which may be fixed or moveable). Such movement changes (increases) the spacing S (FIG. 2) between the top platen 60 and the lower platen 62 to spacing S' (FIG. 2A).

Hard stops may be provided, which limit how close the upper platens 60 and 61 and the lower platens 62 and 63 can approach each other in a normal operating position. Additionally, sensors may be used to detect an actual spacing between the upper platens 60 and 61 and the lower platens 62 and 63 of the gap drying system 59.

In one embodiment, the spacing between the upper platens 60 and 61 and the lower platens 62 and 63 is increased automatically when the vacuum ports 66 are activated. The control system typically activates the solenoid valves 72 and increases the platen spacing S simultaneously. The spacing S between the upper platens 60 and 61 and the lower platens 62 and 63 of the gap drying system 59 increases from the normal processing position (FIG. 2) to the upset position with increased platen spacing S' (FIG. 2A). Those skilled in the art will recognize that spacing of the platens in the normal position, as well as in the upset position, will vary according to the particular configuration of the gap drying system 59 and the particular types of webs 12 and coatings involved. For illustrative purposes only, spacing in the normal position could be about one-quarter (¼) inch (0.635 cm) and spacing in the upset position could be about 1.5 inches (3.81 cm). In addition, because movement of the platens is a mechanical process, the web 12 may still be moving relative the platens before the platens reach the upset position. In other words, the web 12 may still be moving while the spacing between the upper platens 60 and 61 and the lower platens 62 and 63 is still increasing after activation of the vacuum force.

When moving the upper platen 60 or 61 during upset conditions, an occasional drop of condensate falling from the upper platens 60 and 61 onto the second face 16 web of material 12 is not a significant concern. However, increasing the spacing between the upper platens 60 and 61 and the lower platens 62 and 63 of the gap drying system 59 reduces the risk of contact between the second (coating-bearing) face 16 of the web 12 and the condensate-laden upper platens 60 and 61 (i.e., the condensing platens). Due to gravity, any contact between the upper platens 60 and 61 and the web 12 will generally drain a significant amount the condensate from the upper platens 60 and 61 back onto the web 12. Such drainage raises safety and hygiene concerns, for example when the excess condensate runs off the web 12 and collects on machinery and ground surfaces. Contact with the upper condensing platens 60 and 61 further can cause contamination of the upper condensing platens 60 and 61 themselves, and contamination of capillary grooves of the upper platens 60 and 61 with coating material is detrimental to both gap drying system 59 functioning and web coating machine 10 operation.

The web positioning device 42 is suitable for use with webs of material 12 traveling at a wide range of speeds. The particular speed of web travel will vary according suitable parameters for the type of processing desired.

Figure 3:
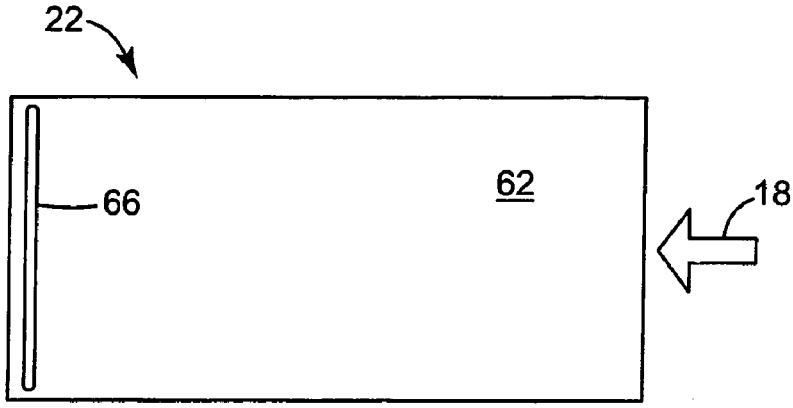
FIG. 3 is a top view of a lower platen of the gap dryer.

FIG. 3 is a top view of the lower platen 63 of the gap dryer 22, showing a first embodiment of the present invention. Each gas flow port 66 is located proximate the first face 14 of the web 12 and activation of the vacuum does not cause contact with the second (coated) face 16 of the web 12. In the preferred embodiment, the gas flow port 66 is an elongate slot located in the lower platen 62 of the gap dryer 22, with the elongate slot arranged substantially perpendicular to a longitudinal direction of travel 18 of the web 12 (i.e., in a cross-web direction). In one embodiment, the gas flow port 66 is located near a downstream end of the lower platen 62 of the gap dryer 22. In further embodiments, the gas flow ports 66 may be positioned elsewhere, such as adjacent one or more of the platens of the gap drying system 59.

The gas flow port 66 creates a void where air or other gases can flow to generate a vacuum force for affecting a position of the web 12 positioned proximate the port 66. Particular dimensions, shape and arrangement of the gas flow ports 66 can vary, as one skilled in the art will recognize. The vacuum force amplitude is affected by the size of the gas flow ports 66. Thus, configuration of the gas flow port 66 will vary according to the types of webs and the types of processing used with the web coating machine. In one embodiment, provided for illustrative purposes only, the gas flow port 66 is 0.125 inch (0.3175 cm) wide in the longitudinal web travel path direction 18. In all embodiments, however, each gas flow port 66 extends across substantially the entire cross-web distance of the platen in order to avoid a lateral heat transfer discontinuity, which can cause striping and other undesirable effects relative to the coating material on the web 12.

Figure 3A:
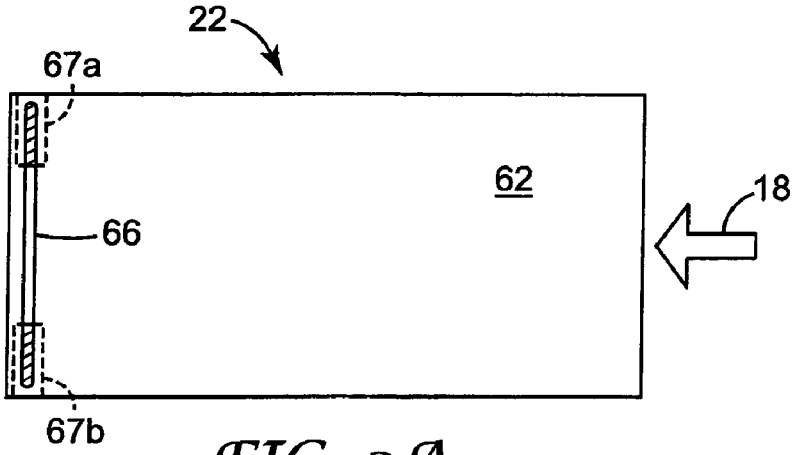
FIG. 3A is a top view of a port structure equipped with deckles.

In further embodiments the gas flow ports 66 are deckled for accommodating variously sized webs of materials. As is known in the art, deckling permits a vacuum force to be activated through less than an entire length of the gas flow port. The gas flow ports 66 are deckled along the lateral or cross-web dimension using deckles 67*a*, 67*b* as shown in FIG.3A. This facilitates use of the same web coating machine and web positioning device for webs of different lateral widths without extensive modifications to the structure or configuration of the web coating machine. The deckles 67*a*, 67*b* conveniently are adjustable mechanically by an operator. Spacing of the deckles 67*a*, 67*b* is adjusted so the gas flow port or ports 66 form a quasi-seal across the web of material. The deckles 67*a*, 67*b* typically are adjusted to a lateral width slightly smaller than a lateral width of the web of material 12, to accommodate steering of the web 12. Generally, the deckles 67*a*, 67*b* are adjusted to fit the narrowest web that will be run through the web coating machine 10. For example, a web coating machine that processes a web with a minimum of a 27 inch (68.58 cm) lateral width could have the deckles 67*a*, 67*b* spaced at about 25 inches (63.5 cm). While response time may improve by making adjustments to widen the spacing of the deckles 67*a*, 67*b* for use with wider webs of materials, such widening of the deckles 67*a*, 67*b* is not necessarily required.

In embodiments with a deckled gas flow port 66, each gas flow port 66 extends across substantially the entire cross-web distance of the platen. Extending the gas flow port in that manner reduces the possibility of a lateral heat transfer discontinuity, which can cause striping and other undesirable effects relative to the coating material on the web 12.

Figure 4:
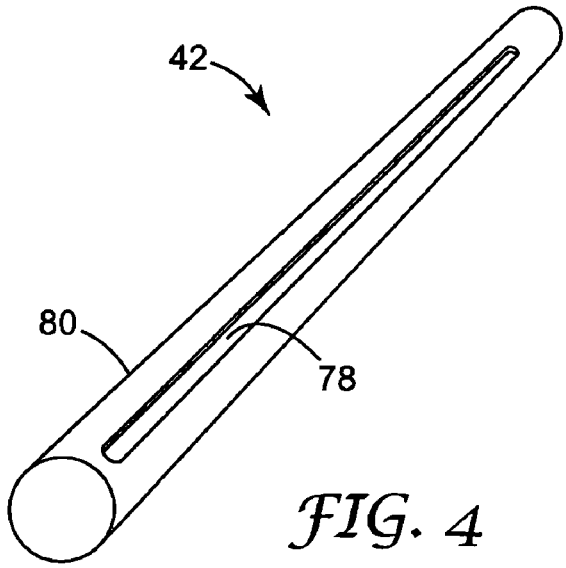
FIG. 4 is a top perspective view of a port structure.

In another embodiment shown in FIG. 4, the web positioning device 42 comprises a gas flow port 78 formed in a port structure 80 located anywhere along a web coating machine. The port structure 80 is typically disposed with a lateral or cross-web orientation relative to a web of material, substantially normal to a longitudinal direction of web travel. Those skilled in the art will recognize that the port structure may be formed in nearly any shape, including platen or pipe shapes. In further embodiments, the gas flow port 78 located in the port structure 80 is deckled for accommodating variously sized webs of material, in the manner described above with respect to previous embodiments.

Figure 5:
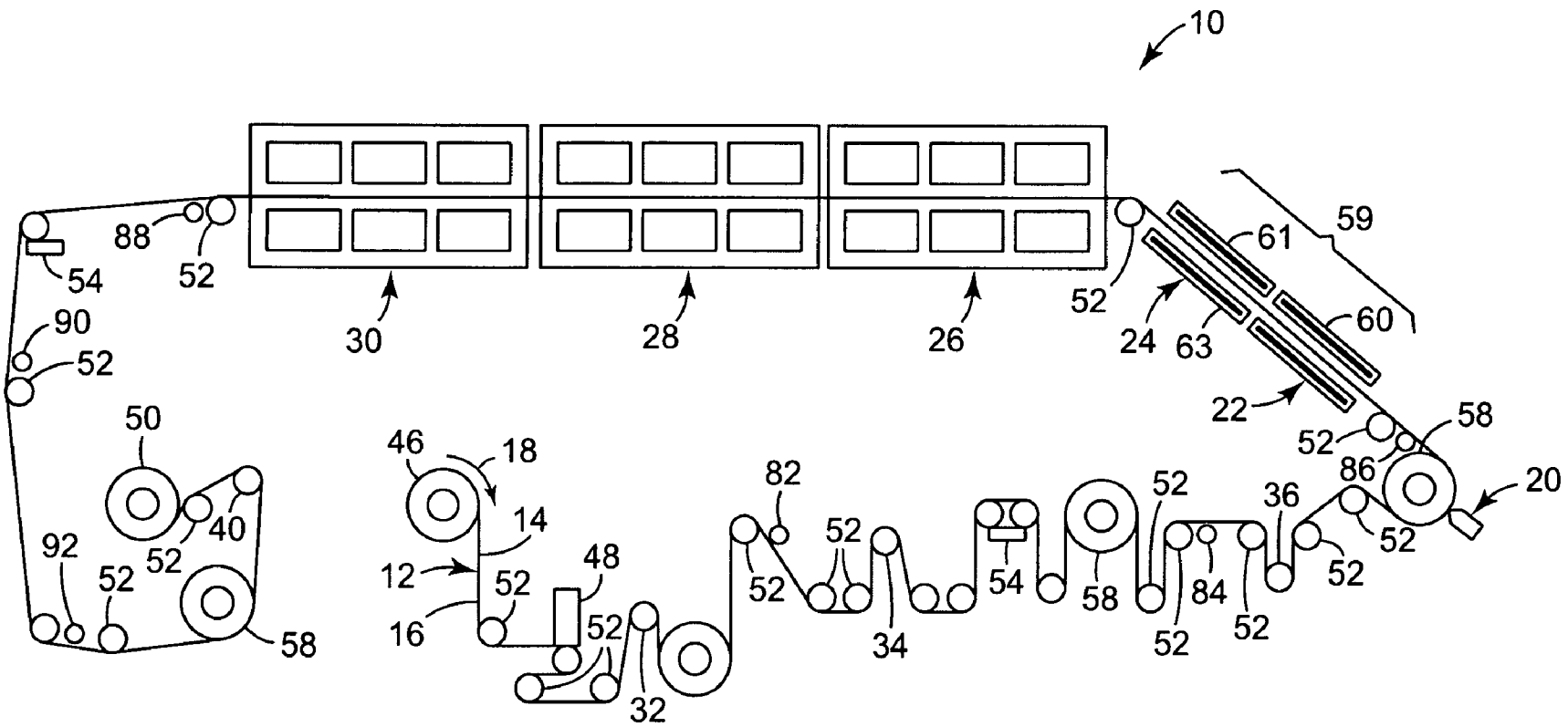
FIG. 5 is a schematic representation of a web coating machine illustrating possible locations for a port structure along the web travel path.

FIG. 5 is a schematic view of possible locations 82–92 for a port structure, such as that shown in FIG. 4, along a web travel path. Locations 82–92 are provided for exemplary purposes only, as other locations for port structures are possible. Moreover, any number of port structures may be located at points along the web coatings machine 10. Often, each port structure 82–92 is located adjacent a roller 52. Moreover, the port structures 82–92 are typically located along the web travel path where web upsets are likely to occur, such as near the coating station 20 and near, or inside of, the air floatation ovens 26–30. Also, the port structures 82–92 may be used in place of mechanical and electrostatic web clamps, in corresponding locations along the web travel path.

As seen in FIG. 5,the port structures 82–92 are typically located on only one side of the web of material 12 (to operatively engage the first face 14 of the web 12). It is desirable to position the port structure 82–92 in close proximity to the web 12 to minimize response time; however, those skilled in the art will recognize that the particular spacing will vary according to such factors as the position of the port structure 82–92 along the web travel path and the amount of "play" or "flutter" in the web 12 (i.e., movement of the web is a direction orthogonal to a face of the web). Activation of a vacuum force through the gas flow port 78 on the port structure 80 (or, e.g., port structures 82–92) can be achieved in substantially the same manner as generally illustrated for the gas flow port 66 in FIG. 2 (i.e., the gas flow port 78 is operably connected to a vacuum source by suitable conduits, manifolds, and valves, which are opened and closed in response to a controller and specified operating conditions).

A method for controlling movement of a portion of a web of material 12 held in tension using the web positioning device described above includes monitoring a longitudinal tension of the web 12, and utilizing one or more gas flow ports located relative an insensitive or uncoated face of the portion of the web 12 to generate a vacuum force, with the vacuum force activated as a function of the longitudinal tension of the web 12 to draw that face into contact with each port and its associated structure. The vacuum force is typically activated based upon a predetermined variance in longitudinal tension of the portion of the web 12. The variance may be an increase or a decrease in longitudinal tension. The amount of variance will vary according to the particular web processing application involved, and the degree of inconvenience that a web upset would pose in connection with that web processing application. In most applications, the amount of vacuum force needing to be provided is such that activation of the vacuum force is capable of holding the relevant portion of the web 12 in a static position. In further embodiments, a distance between a condensing platen of the gap drying system 59 and the portion of the web 12 is increased while the vacuum force is activated.

EXAMPLE

Test data of a web positioning device of the present invention indicates performance of two embodiments of the web positioning device with simulated web breaks. Tables 1 and 2 illustrate results of testing two embodiments of the web positioning device described above.

Table 1 shows test data for web positioning devices 42 located in the lower platens 62 and 63 of the gap dryers 22 and 24, as shown in FIGS. 1–3. Two gas flow ports 66 were provided, each located one inch from the end of its respective lower platen in the gap drying zone. Each port 66 was 0.125 inches (0.3175 cm) wide by 8 inches (20.32 cm) long (in the cross web direction). The lower platens 62 and 63 were each 10 inches in the cross-web direction by 60 inches in the longitudinal direction with an 80 ft radius also in the longitudinal direction, with the gas flow port 66 substantially centered in the lower platens 62 and 63 in the cross-web direction. The web positioning device 42 utilized a vacuum force of 17 inches Hg at 0° C. (56 kPa). The sensor 38 was located after air floatation ovens 26–30 and outfeed steering unit 54, and, in this example, was a tension roll used for detecting web upsets. Use of sensor 38 for detecting web upsets though the gap drying system 59 and the air floatation ovens 26–30 is not ideal, but it is necessary to utilize a tension roll in the tension zone including the coating station and the gap dryer (i.e., between the pull roll 58 at the coating station 20 and the next downstream pull roll 58). The web of material 12 used was 0.002 inch (0.0051 cm) thick, 9 inch (22.86 cm) wide PET. An intentional web break was generated just upstream from the web coating station 20.

With respect to the data in Table 1, the "Deviation Setpoint" of 5 lbs (22.2 N) means that if and when a longitudinal web tension at sensor 38 drops to 5 lbs (22.2 N) or lower, then a signal is sent to the system controller that activates web positioning device 42. In further embodiments, this deviation setpoint could also be setup as a percent of web tension, in either +, −, or +/−.

"Distance" refers to the distance a downstream end of a portion of web 12 traveled after the simulated web break. The infinity symbol (∞) indicates that the web 12 advanced (i.e., pulled) through the web coating machine 10 without stopping.

"Machine Tension" refers to a force applied by the web coating machine 10 on the web 12 in the longitudinal direction. The tension of the web 12 is calculated by dividing machine tension force (in lbs or N) by web width (inches or cm) to get lbs/in or pli (or N/cm). For example, the web tension in this example is: 9 lbs/9 inches=1 pli. (40 N/22.86 cm=1.7 N/cm).

TABLE 1

| Web Speed in ft/min (m/min) | Machine Tension in lbs (N) | Vacuum System (on/off) | Deviation Setpoint in lbs (N) | Distance in ft (m) |
|---|---|---|---|---|
| 50 (15.24) | 9 (40) | Off | — | ∞ |
| 300 (91.44) | 9 (40) | Off | — | ∞ |
| 500 (152.4) | 9 (40) | Off | — | ∞ |
| 50 (15.24) | 9 (40) | On | 5 (22.2) | 0.7 (0.2134) |
| 300 (91.44) | 9 (40) | On | 5 (22.2) | 3 (0.9144) |
| 300 (91.44) | 9 (40) | On | 5 (22.2) | 4.5 (1.3716) |
| 500 (152.4) | 9 (40) | On | 5 (22.2) | 11 (3.3528) |

Table 1 summarizes the distance web 12 travels after a simulated web upset for a range of possible longitudinal web speeds. The range of web speeds shown in Table 1 is illustrative only, as other web speeds may be used.

Although the present invention has been described with reference to preferred embodiments, workers skilled in the art will recognize that changes may be made in form and detail without departing from the spirit and scope of the invention. For example, vacuum ports having shapes and arrangements other than elongate or linear slots are contemplated.

What is claimed is:

1. A web positioning device for use with a gap drying system, the device comprising:

one or more ports positioned in or adjacent at least one platen of the gap drying system, wherein upon generation of a vacuum force through each port, movement of a web of material conveyed through the gap drying system is arrested by drawing a first face of the web of material into contact with a portion of the web positioning device immediately surrounding each port, and wherein each port is deckled for accommodating variously sized webs of materials.

2. A method for controlling movement of a portion of a web of material held in tension, the method comprising:

monitoring a longitudinal tension of the web of material; and utilizing one or more gas flow ports located relative a first face of the portion of the web of material to generate a vacuum force, the vacuum force activated as a function of the tension of the web of material.

3. The method of claim 2 wherein the vacuum force is activated based upon a predetermined variance in longitudinal tension of the portion of the web of material.

4. The method of claim 2 wherein activation of the vacuum force holds the portion of the web of material in a static position.

5. The method of claim 2 wherein each gas flow port is in or adjacent a lower platen of a gap drying system, which has an upper condensing platen spaced therefrom, and further comprising:

increasing a distance between the upper condensing platen and the portion of the web of material while the vacuum force is activated.

6. The method of claim 2 wherein activation of the vacuum reduces movement of the web of material by drawing the first face of the web of material into contact with a portion of the web positioning device immediately surrounding one of more of the gas flow ports, and wherein activation of the vacuum does not cause contact with a second face of the web of material.

7. An improved coating machine for coating a web of material having a first face end an opposite second face, the coating machine including a gap dryer, the improvement comprising:

a web positioning device for activating a vacuum that acts only on the first face of the web of material to arrest movement of the web of material relative to the gap dryer wherein the web positioning device includes a first vacuum port disposed on only one side of the web of material end relative to the first face of the web of material and wherein the first vacuum port is decided for accommodating variously sized webs of materials.

8. An improved coating machine for coating a web of material having a first face and an opposite second face, the coating machine including a gap dryer, the improvement comprising:

a web positioning device for activating a vacuum that acts only on the first face of the web of material to arrest movement of the web of material relative to the gap dryer wherein the web positioning device includes a first vacuum port disposed on only one side of the web of material and relative to the first face of the web of material, and further comprising a second vacuum port spaced longitudinally along a path of the web of material from the first vacuum port.

9. An improved coating machine for coating a web of material having a first face and an opposite second face, the coating machine including a gap dryer, the improvement comprising:

a web positioning device for activating a vacuum that acts only on the first face of the web of material to arrest movement of the web of material relative to the gap dryer wherein the web positioning device includes a first vacuum port disposed on only one side of the web of material and relative to the first face of the web of material and wherein a spacing between two opposed platens of the gap drying system is increased while the vacuum is activated.

10. A gap drying system for drying a wet coating on one face of a web of material moving longitudinally over a web processing path, the gap drying system comprising:

a lower platen disposed in the web processing path; and an upper platen disposed along the web processing path and spaced from the lower platen by a first spacing, wherein upon the occurrence of a specified condition which affects movement of the web of material along the web processing path and between the lower and upper platens, a vacuum force draws the web of material toward the lower platen and the first spacing between the lower platen and the upper platen is increased.

11. The gap drying system of claim 10 wherein the specified condition is an upset of the web of material.

* * * * *

UNITED STATES PATENT AND TRADEMARK OFFICE

CERTIFICATE OF CORRECTION

PATENT NO. : 6,996,921 B2
APPLICATION NO. : 10/778297
DATED : February 14, 2006
INVENTOR(S) : Kolb, William B. et al.

It is certified that error appears in the above-identified patent and that said Letters Patent is hereby corrected as shown below:

Column 6 – Line 18 - Delete "cross web" and insert - - cross-web - -, therefor.

Column 7 – Line 26 - Delete "the web the web 12" and insert - - the web 12, the web 12 - -, therefor.

Column 7 – Line 36-58 -- Delete "In one embodiment, the spacing between the……..63 is still increasing after activation of the vacuum force." and insert new paragraph- - In one embodiment, when the vacuum force is…….will recognize that other velocities are acceptable. - -, therefor.

Column 8 – Line 30 - After "relative" insert - - to - -.

Column 10 – Line 37 - After "relative" insert - - to - -.

Column 11 – Line 3 - Delete "cross web" and insert - - cross-web - -, therefor.

Column 12 – Line 14 - after "relative" insert - - to - -.

Column 12 – Line 40 (Approx.) - delete "end" and insert - - and - -, therefor.

Column 12 – Line 48 (Approx.) - delete "end" and insert - - and - -, therefor.

Column 12 – Line 49 (Approx.) - delete "decided" and insert - - deckled - -, therefor.

Signed and Sealed this

First Day of August, 2006

JON W. DUDAS
*Director of the United States Patent and Trademark Office*